US006071738A

United States Patent [19]

Johnson et al.

[11] Patent Number: 6,071,738

[45] Date of Patent: Jun. 6, 2000

[54] CONVERSION OF ORGANOSULFUR COMPOUNDS TO OXYORGANOSULFUR COMPOUNDS FOR DESULFURIZATION OF FOSSIL FUELS

[75] Inventors: Steven W. Johnson, Portsmouth, N.H.; Daniel J. Monticello, The Woodlands, Tex.; Charles Hazan, Paris; Jean-Michel Colin, Le Havre, both of France

[73] Assignee: Energy BioSystems Corporation, The Woodlands, Tex.

[21] Appl. No.: 08/933,885

[22] Filed: Sep. 19, 1997

[51] Int. Cl.[7] ..... C12S 1/02

[52] U.S. Cl. ..... 435/282; 435/281; 435/130

[58] Field of Search ..... 435/262, 262.5, 435/281, 282, 252.3, 130

[56] References Cited

U.S. PATENT DOCUMENTS

| | | | |
|---|---|---|---|
| 4,562,156 | 12/1985 | Isbister et al. | 435/253 |
| 5,002,888 | 3/1991 | Kilbane, II | 435/252.31 |
| 5,104,801 | 4/1992 | Kilbane, II | 435/282 |
| 5,132,219 | 7/1992 | Kilbane, II | 435/195 |
| 5,198,341 | 3/1993 | Kilbane, II | 435/42 |
| 5,344,778 | 9/1994 | Kilbane, II | 435/262 |
| 5,356,801 | 10/1994 | Rambosek et al. | 435/195 |
| 5,356,813 | 10/1994 | Monticello | 435/282 |
| 5,358,870 | 10/1994 | Monticello et al. | 435/282 |
| 5,529,930 | 6/1996 | Monticello et al. | 435/281 |
| 5,607,857 | 3/1997 | Grossman et al. | 435/282 |
| 5,879,914 | 3/1999 | Rambosek et al. | 435/130 |

OTHER PUBLICATIONS

Zannikos et al. "Desulfurization of petroleum fractions by oxidation and solvent extraction." Fuel Processing Technology. vol. 42 (1995), pp. 35–45.

Bezalel et al. "Initial Oxidation Products in the Metabolism of Pyrene, Anthracene, Fluorene, and Dibenzothiophene by the White Rot Fungus Pleurotus ostreatus." Applied and Environmental Microbiology. vol. 62, No. 7 (Jul. 1996), pp. 2554–2559.

Mormile et al. "Mineralization of the Dibenzothiophene Biodegradation Products 3–Hydoxy–2–Formyl Benzothiophene and Dibenzothiophene Sulfone." Applied and Environmental Microbiology. vol. 54, No. 12 (Dec. 1988), pp. 3183–3184.

Olson et al. "Characterization of Intermediates in the Microbial Desulfurization of Dibenzothiophene." Energy & Fuels. vol. 7 (1993), pp. 159–164.

Van Afferden. "Biochemical mechanisms for the desulfurization of coal–relevant organic sulfur compounds." Fuel. vol. 72, No. 12 (1993), pp. 1635–1643.

Monticello, D.J. et al., "Practical Considerations in Biodesulfurization on Petroleum," IGT's Third International Symposium on Gas, Oil, Coal and Environmental Biotechnology, New Orleans, LA (Dec. 3–5, 1990).

Li, M.Z. et al., "Genetic Analysis of the dsz Promoter and Associated Regulatory Regions of *Rhodococcus erythropolis* IGTS8," *J. Bacteriol.,* 178(22): 6409–6418 (Nov. 1996).

Constanti, M. et al., "Degradation and desulfurization of dibenzothiophene sulfone and other sulfur compounds by Agrobacterium MC501 and a mixed culture," *Enzyme Microb. Tech.,* 19: 214–219 (1996).

Kilbane, J.J. "Biodesulfurization: Future Prospects in Coal Cleaning," in *Proc. 7th Ann. Int'l. Pittsburgh Coal Conf.:* 373–382 (Sep. 10–14, 1990).

Piddington, C.S. et al., "Sequence and Molecular Characterization of a DNA Region Encoding the Dibenzothiophene Desulfurization Operon of Rhodococcus sp. Strain IGTS8," *App. Environ. Microbiol.,* 61(2): 468–475 (Feb. 1995).

Kilbane II, J.J., "Sulfur–Specific Microbial Metabolism of Organic Compounds," *Resour. Cons. Recycl. 3*: 69–79 (1990).

Hartdegan, F.J. et al., "Microbial Desulfurization of Petroleum: Developments in genetic engineering have led to the possibility of a bioprocess route to clean up sulfur in oil," *Chem. Eng. Progress:* 63–67 (May 1984).

Monitcello, D.J. and Finnerty, W.R., "Microbial Desulfurization of Fossil Fuels," *Ann. Rev. Microbiol.,* 39: 371–389 (1985).

Gundlach, E.R., et al., "The Fate of Amoco Cadiz Oil," *Science,* 221: 122–129 (1983).

Yen, K.–M., "Construction of Cloning Cartridges for Development of Expression Vectors in Gram–Negative Bacteria," *J. Bacteriol.,* 173: 5328–5335 (1991).

Omori, T., et al., "Desulfurization of Dibenzothiophene by Corynebacterium sp. Strain SY1," *Appl. Env. Microbiol.,* 58(3): 911–915 (1992).

Izumi, Y., et al., "Selective Desulfurization of Dibenzothiophene by *Rhodococcus erythropolis* D–1," *Appl. Env. Microbiol.,* 60(1): 223–226 (1994).

Lee, M.K., et al., "Sulfur–Specific Microbial Desulfurization of Sterically Hindered Analogs of Dibenzothiophene," *Appl. Environ. Microbiol.,* 61(12): 4362–4366 (1995).

Gray, K.A., et al., "Molecular mechanisms of biocatalytic desulfurization of fossil fuels," *Nature Biotech.,* 14: 1705–1709 (1996).

Altschul, S.F., et al., "Basic Local Alignment Search Tool," *J. Mol. Biol.,* 215: 403–410 (1990).

Denome, S.A., et al., "Characterization of the Desulfurization Genes from Rhodococcus sp. Strain IGTS8," *J. Bacteriol.,* 176(21): 6707–6716 (1994).

Foght, J.M. and Westlake, D.W.S., "Expression of dibenzothiophene–degradative genes in two Pseudomonas species," *Can. J. Microbiol.,* 36: 718–724 (1990).

Monticello, D.J., et al., "Plasmid–Mediated Degradation of Dibenzothiophene by Pseudomonas species," *Appl. Environ. Microbiol.,* 49(4): 756–760 (1985).

*Primary Examiner*—William H. Beisner

*Attorney, Agent, or Firm*—Hamilton, Brook, Smith & Reynolds, P.C.

[57] ABSTRACT

The present invention relates to a method for the desulfurization of a fossil fuel containing one or more organosulfur compounds. In one embodiment, the method comprises the steps of (1) contacting the fossil fuel with a biocatalyst capable of converting the organosulfur compound to an oxyorganosulfur compound which is separable from the fossil fuel; and (2) separating the oxyorganosulfur compound from the fossil fuel. The oxyorganosulfur compound can then be isolated, discarded or further processed, for example, via desulfurization by a biocatalyzed process or an abiotic process, such as hydrodesulfurization.

21 Claims, 3 Drawing Sheets

CONVERSION OF ORGANOSULFUR COMPOUNDS TO OXYORGANOSULFUR COMPOUNDS FOR DESULFURIZATION OF FOSSIL FUELS

BACKGROUND OF THE INVENTION

The microbial desulfurization of fossil fuels has been an area of active investigation for over fifty years. The object of these investigations has been to develop biotechnology based methods for the pre-combustion removal of sulfur from fossil fuels, such as coal, crude oil and petroleum distillates. The driving forces for the development of desulfurization methods are the increasing levels of sulfur in fossil fuel and the increasingly stringent regulation of sulfur emissions (Monticello et al., "Practical Considerations in Biodesulfurization of Petroleum," IGT's 3d Intl. Symp. on Gas, Oil, Coal and Env. Biotech., (Dec. 3–5, 1990) New Orleans, La.).

Many biocatalysts and processes have been developed to desulfurize fossil fuels, including those described in U.S. Pat. Nos. 5,356,801, 5,358,870, 5,358,813, 5,468,626, 5,198,341, 5,132,219, 5,344,778, 5,104,801, 5,002,888, and Ser. No. 08/351,754, now abandoned (EBC94-08), incorporated herein by reference. Economic analyses indicate that one limitation in the commercialization of the technology is improving the reaction rates and specific activities of the biocatalysts, such as the bacteria and enzymes that are involved in the desulfurization reactions.

Current methods for the biodesulfurization of fossil fuels result in the formation of an aqueous sulfate solution. Disposal of the waste sulfate is a significant problem. For example, sulfate can be precipitated from solution by addition of an appropriate metal ion, but the resulting solid salt must be disposed of in a landfill. Alternatively, the sulfate can be transformed into another substance, such as hydrogen sulfide, which is then treated via conventional refinery processes. Both methods add significantly to the cost of biodesulfurized fuels.

There is, thus, a need for a method of desulfurizing fossil fuels using biocatalysis which does not produce sulfate or other by-products which present significant disposal problems.

SUMMARY OF THE INVENTION

The present invention relates to a method for the desulfurization of a fossil fuel containing one or more organosulfur compounds. In one embodiment, the method comprises the steps of (1) contacting the fossil fuel with a biocatalyst capable of converting the organosulfur compound to an organosulfur metabolite which is separable from the fossil fuel; and (2) separating the organosulfur metabolite from the fossil fuel. The organosulfur metabolite can then be isolated, discarded or further processed, for example, via desulfurization by a biocatalyzed process or an abiotic process, such as hydrodesulfurization.

In another embodiment, the method of the present invention comprises the steps of (1) contacting the fossil fuel with a biocatalyst capable of oxidizing the organosulfur compound to an oxyorganosulfur compound; and (2) separating the oxyorganosulfur compound from the fossil fuel.

In one embodiment, the oxyorganosulfur compound is water soluble and can be separated from the fossil fuel by contacting the fossil fuel with an aqueous phase, thereby extracting the oxyorganosulfur compound into the aqueous phase.

The present invention offers several advantages over the prior art. For example, unlike prior art methods, the present method does not result in the formation of sulfate, with its attendant disposal costs. The method instead can yield high-value organosulfur compounds which can be isolated and used or sold. The method can also produce oxyorganosulfur compounds which are readily desulfurized in a conventional refinery process, for example, as a component of an oil stream.

DETAILED DESCRIPTION OF THE INVENTION

Figure 1:
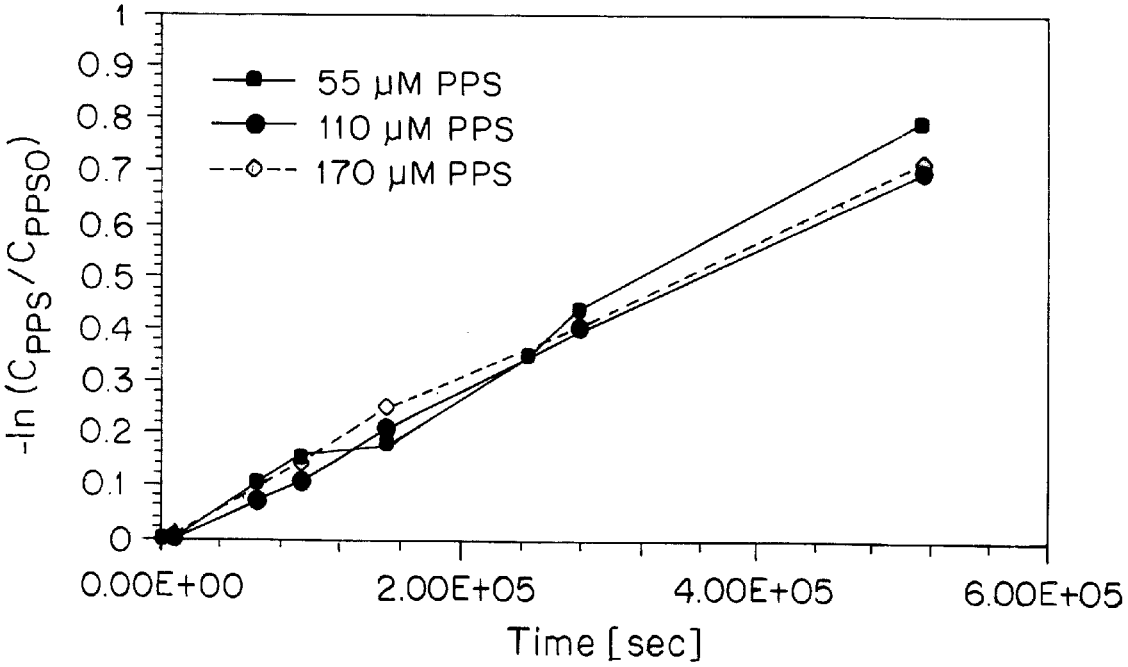
FIG. 1 is a plot of $-\ln([HPBS]/[HPBS]_o)$ versus time for solutions originally 55 $\mu$M, 110 $\mu$M and 170 $\mu$M in HPBS at pH 1.25.

The features and other details of the present invention will now be more particularly described and pointed out in the claims. The particular embodiments of the invention are shown by way of illustration and not as limitations of the invention. The principal features of this invention can be employed in various embodiments without departing from the scope of the invention.

The present invention is based on the discovery that the biodesulfurization of a fossil fuel can be stopped at an intermediate stage and that the intermediate metabolite can be removed from the fossil fuel by exploiting the physical and chemical properties of the intermediate. The intermediate metabolite can then be processed, for example, via a biocatalyzed process or a conventional, abiotic process, discarded or recovered.

The invention provides a method of desulfurizing a fossil fuel containing one or more organosulfur compounds. The method comprises the steps of (1) contacting the fossil fuel with a biocatalyst capable of converting the organosulfur compound into an organosulfur metabolite which is separable from the fossil fuel; and (2) separating the organosulfur metabolite from the fossil fuel.

As used herein, the term "desulfurization" refers to a process by which sulfur atoms are removed from a carbonaceous material, such as a fossil fuel. Desulfurization can result from the removal of one or more organosulfur compounds from the carbonaceous material, or from the removal of sulfur atoms from one or more organosulfur compounds within the fossil fuel.

The term "separable", as used herein, describes a compound which can be substantially removed from a fossil fuel by a physical or chemical process. Suitable physical processes include extraction, precipitation and adsorption, for example, onto a polar solid support, such as silica gel or alumina. Suitable chemical processes include reacting the organosulfur metabolite with a suitable agent to form a complex which can be separated from the fossil fuel. Thus, in the present invention, the organosulfur metabolite differs from the organosulfur compound in at least one physical or chemical aspect which can be exploited to remove the organosulfur metabolite from the fossil fuel.

In one embodiment, the fossil fuel is a liquid hydrocarbon, such as oil. The organosulfur metabolite is substantially insoluble in oil and precipitates as a solid which can then be removed from the oil, for example, by filtration. The organosulfur metabolite can also be more polar than the organosulfur compound. In this case the organosulfur metabolite can exhibit enhanced solubility in polar solvents, such as water, compared to the organosulfur compound. The organosulfur intermediate can, thus, be removed from the fossil fuel by contacting the fossil fuel with an polar solvent which is immiscible with oil, such as an aqueous phase. In another embodiment, the organosulfur metabolite is not appreciably soluble in a polar solvent, but can be extracted into a polar solvent in which is dissolved an agent, for example, a metal salt, which reacts with the organosulfur metabolite to form a complex which is soluble in the polar solvent.

In one embodiment, the biocatalyst oxidizes the organosulfur compound, thereby forming an oxidized organosulfur metabolite, such as an oxyorganosulfur compound. An "oxyorganosulfur" compound, as the term is used herein, is an organosulfur compound which comprises sulfur-oxygen bonds. Examples of oxyorganosulfur compounds include sulfoxides, sulfones, sulfinates and sulfonates.

Oxidation of an organic compound typically increases its polarity and, therefore, its solubility in polar solvents. In a preferred embodiment, the biocatalyst oxidizes the organosulfur compound to form an water-soluble oxyorganosulfur compound. The water-soluble oxyorganosulfur compound can then be removed from the fossil fuel by contacting the fossil fuel with an aqueous phase, thereby extracting the oxyorganosulfur compound into the aqueous phase.

The term "organosulfur compound" refers to organic molecules which have a hydrocarbon framework to which one or more sulfur atoms are covalently joined. These sulfur atoms can be directly bonded to the hydrocarbon framework, e.g., by one or more carbon-sulfur bonds, or can be present in a substituent bonded to the hydrocarbon framework of the molecule, e.g., a sulfate group. The hydrocarbon portion of these compounds can be aliphatic and/or aromatic.

In one embodiment, the organosulfur compound is a sulfur-bearing-heterocycle, such as a substituted or unsubstituted thiophene, benzothiophene or dibenzothiophene. Such compounds are known to be stable to conventional desulfurization treatments, such as hydrodesulfurization (HDS). Sulfur-bearing heterocycles can have relatively simple or relatively complex chemical structures. In complex heterocycles, multiple condensed aromatic rings, one or more of which can be heterocyclic, are present. The difficulty of desulfurization generally increases with the structural complexity of the molecule. That is, refractory behavior is particularly accentuated in complex sulfur-bearing heterocycles, such as dibenzothiophene (DBT, $C_{12}H_8S$).

DBT is a sulfur-bearing heterocycle that has a condensed, multiple aromatic ring structure in which a five-membered thiophenic ring is flanked by two six-membered benzo rings. Much of the residual post-HDS organic sulfur in fossil fuel refining intermediates and combustible products is thiophenic sulfur. The majority of this residual thiophenic sulfur is present in DBT and derivatives thereof having one or more alkyl or aryl groups attached to one or more carbon atoms present in one or both flanking benzo rings. DBT itself is accepted as a model compound illustrative of the behavior of the class of compounds encompassing DBT and derivatives thereof in reactions involving thiophenic sulfur (Monticello and Finnerty, *Ann. Rev. Microbiol.,* 39: 371–389 (1985)). DBT and derivatives thereof can account for a significant percentage of the total sulfur content of particular crude oils, coals and bitumen. For example, these sulfur-bearing heterocycles have been reported to account for as much as 70 wt % of the total sulfur content of West Texas crude oil, and up to 40 wt % of the total sulfur content of some Middle East crude oils. Thus, DBT is considered to be particularly relevant as a model compound for the forms of thiophenic sulfur found in fossil fuels, such as crude oils, coals or bitumen of particular geographic origin, and various refining intermediates and fuel products manufactured therefrom (Monticello and Finnerty (1985), supra). Another characteristic of DBT and derivatives thereof is that, following a release of fossil fuel into the environment, these sulfur-bearing heterocycles persist for long periods of time without significant biodegradation. Gundlach et al., *Science* 221: 122–129 (1983). Thus, most prevalent naturally occurring microorganisms do not effectively metabolize and break down sulfur-bearing heterocycles.

A fossil fuel that is suitable for desulfurization treatment according to the present invention is one that contains organic sulfur. Such a fossil fuel is referred to as a "substrate fossil fuel". Substrate fossil fuels that are rich in thiophenic sulfur are particularly suitable for desulfurization according to the method described herein. Examples of such substrate fossil fuels include Cerro Negro or Orinoco heavy crude oils; Athabascan tar and other types of bitumen; petroleum refining fractions such as light cycle oil, heavy atmospheric gas oil, and No. 1 diesel oil; shale oil and shale oil fractions and coal-derived liquids manufactured from sources such as Pocahontas #3, Lewis-Stock, Australian Glencoe or Wyodak coal.

Several investigators have reported the genetic modification of naturally-occurring bacteria into mutant strains capable of catabolizing DBT. Kilbane, J. J., *Resour. Cons. Recycl.* 3: 69–79 (1990), Isbister, J. D., and R. C. Doyle, U.S. Pat. No. 4,562,156 (1985), and Hartdegan, F. J. et al., *Chem. Eng. Progress:* 63–67 (1984). For the most part, these mutants desulfurize DBT nonspecifically, and release sulfur in the form of small organic sulfur breakdown products. Thus, a portion of the fuel value of DBT is lost through this microbial action. Isbister and Doyle reported the derivation of a mutant strain of Pseudomonas which appeared to be capable of selectively liberating sulfur from DBT, but did not elucidate the mechanism responsible for this reactivity.

Kilbane has reported a mixed bacterial culture which appeared capable of selectively liberating sulfur from DBT by the oxidative pathway. This culture was composed of bacteria obtained from natural sources such as sewage sludge, petroleum refinery wastewater, garden soil, coal tar-contaminated soil, etc., and maintained in culture under conditions of continuous sulfur deprivation in the presence of DBT. The culture was then exposed to the chemical mutagen 1-methyl-3-nitro-1-nitrosoguanidine. The major catabolic product of DBT metabolism by this mutant culture was 2-hydroxybiphenyl; sulfur was released as inorganic water-soluble sulfate, and the hydrocarbon portion of the molecule remained essentially intact as 2-hydroxybiphenyl. Kilbane, J. J., *Resour. Cons. Recycl.* 3: 69–79 (1990), the teachings of which are incorporated herein by reference.

Kilbane isolated a mutant strain of Rhodococcus from this mixed bacterial culture. This mutant, IGTS8 or ATCC No. 53968, can be modified to form a particularly preferred biocatalyst for use in the present method. The isolation and characteristics of this mutant are described in detail in J. J. Kilbane, U.S. Pat. No. 5,104,801, the teachings of which are incorporated herein by reference. This microorganism has been deposited at the American Type Culture Collection (ATCC), 10801 University Boulevard, Manassas, Va., U.S.A., 20110-2209 under the terms of the Budapest Treaty, and has been designated as ATCC Deposit No. 53968 on Dec. 1, 1989. One suitable ATCC No. 53968 biocatalyst preparation is a culture of the living microorganisms, prepared generally as described in U.S. Pat. No. 5,104,801 and mutants or derivatives thereof. Cell-free enzyme preparations obtained from ATCC No. 53968 or mutants thereof generally as described in U.S. Pat. Nos. 5,132,219, and 5,358,870 can also be used.

There are at least two possible types of pathways which result in the specific release of sulfur from DBT: oxidative and reductive. Preferably, an oxidative (aerobic) pathway can be followed. Examples of microorganisms that act by this oxidative pathway, modified preparations of which are suitable for use as the biocatalyst in the present invention include the microbial consortium (a mixture of several microorganisms) disclosed in Kilbane, *Resour. Conserv. Recycl.,* 3: 69–79 (1990), the microorganisms disclosed in U.S. Pat. No. 5,002,888 (issued Mar. 26, 1991), U.S. Pat. No. 5,104,801 (issued Apr. 14, 1992), U.S. Pat. Nos. 5,344,778, 5,132,219, 5,198,341, 5,356,813, 5,356,801, 5,358,870 [also described in Kilbane (1990), *Biodesulfurization: Future Prospects in Coal Cleaning, in Proc, 7th Ann. Int'l. Pittsburgh Coal Conf.:* 373–382], and U.S. Pat. No. 5,198,341 (issued Mar. 30, 1993). Other desulfurizing microorganisms which are suitable biocatalyst sources include Corynebacterium sp. strain SY1, as disclosed by Omori et al., *Appl. Env. Microbiol.,* 58: 911–915 (1992); *Rhodococcus erythropolis* D-1, as disclosed by Izumi et al., *Appl. Env. Microbiol.,* 60: 223–226 (1994); the Arthrobacter strain described by Lee et al., *Appl. Environ. Microbial.* 61: 4362–4366 (1995) and the Rhodococcus strains (ATCC 55309 and ATCC 55310) disclosed by Grossman et al., U.S. Pat. No. 5,607,857, each of which is incorporated herein by reference in its entirety. Each of these microorganisms is believed to produce one or more enzymes (protein biocatalysts) that catalyze one or more reactions in the desulfurization of DBT.

Additional biocatalysts of use in the desulfurization process now described can be derived from naturally occurring microorganisms by known techniques. As set forth above, these methods involve culturing preparations of microorganisms obtained from natural sources such as sewage sludge, petroleum refinery wastewater, garden soil, or coal tar-contaminated soil under selective culture conditions in which the microorganisms are grown in the presence of refractory organosulfur compounds such as sulfur-bearing heterocycles as the sole sulfur source; exposing the microbial preparation to chemical or physical mutagens; or a combination of these methods. Such techniques are recounted by Isbister and Doyle in U.S. Pat. No. 4,562,156 (issued Dec. 31, 1985); and by Kilbane in *Resour. Conserv. Recycl.,* 3: 69–79 (1990), U.S. Pat. Nos. 5,002,888, 5,104,801 and 5,198,341; and by Omori and coworkers in *Appl. Env. Microbiol.,* 58: 911–915 (1992), all incorporated herein by reference.

Preferred sources of biocatalysts of use herein are Rhodococcus strain IGTS8, as discussed above, and Sphingomonas sp. strain AD109, as disclosed in U.S. patent application Ser. No. 08/851,089 (Attorney's Docket No. EBC97-06A), incorporated herein by reference Sphingomonas strain AD109 has been deposited at the American Type Culture Collection (ATCC), 10801 University Boulevard, Manassas, Va., U.S.A., 20110-2209 under the terms of the Budapest Treaty and has been designated as ATCC Deposit No. 55954 on Apr. 21, 1997. Other sources of the biocatalyst include recombinant organisms which contain heterologous Rhodococcus and/or Sphingomonas genes which encode desulfurization enzymes. Suitable examples include recombinant organisms derived from pseudomonad host organisms, as are described in U.S. patent application Ser. No. 08/851,088 (Attorney's Docket No. EBC96-06A), now U.S. Pat. No. 5,952,208, incorporated herein by reference.

The biocatalysts discussed above are capable of desulfurizing DBT to form, in the case of Rhodococcus IGTS8 and Sphingomonas strain AD109, inorganic sulfate and 2-hydroxybiphenyl. Biocatalysts of use in the present method, however, should not remove sulfur from the organosulfur compound under the conditions employed for the biocatalytic reaction. That is, the product of the biocatalytic process, the organosulfur metabolite, should be an organosulfur compound, such as an oxidized organosulfur compound, and no substantial amounts of inorganic sulfur should be formed.

Each of the foregoing microorganisms can function as a desulfurization biocatalyst because each produces one or more enzymes (protein biocatalysts) that carry out the specific chemical reaction(s) by which sulfur is excised from refractory organosulfur compounds. Such organisms can be employed as the biocatalyst of the present invention if the desulfurization of the organosulfur compound can be stopped at an intermediate stage, that is, prior to excision of the sulfur atom and the formation of inorganic sulfur. This can be done by eliminating one or more enzymatic activities at the terminal end of the biodesulfurization process. In one embodiment, this is accomplished by operating the process of the invention under conditions which significantly inactivate one or more enzymes at the terminal end of the biodesulfurization process. This can be done, for example, via control of conditions such as reaction temperature, pH and ionic strength. The reaction system can also include one or more substances which inhibit the activity of one or more enzymes at the terminus of the biodesulfurization process. In a preferred embodiment, the appropriate enzyme activity or activities are removed from the biodesulfurization catalyst by removing, or suppressing the expression of, one or more genes encoding the appropriate enzyme(s).

For example, Rhodococcus sp. strain IGTS8 desulfurizes dibenzothiophene via the process shown below, which employs the enzymes DszA, DszB, DszC and DszD. DszC is a monooxygenase which catalyzes the oxidation of DBT to the corresponding sulfone, dibenzothiophene-5,5-dioxide ($DBTO_2$). DszA is a monooxygenase which catalyzes the oxidation of $DBTO_2$ to 2-(2'-hydroxyphenyl) benzenesulfinate (HPBS). A number of other desulfurizing organisms, including Sphingomonas sp. strain AD109, are believed to desulfurize DBT via a similar mechanism.

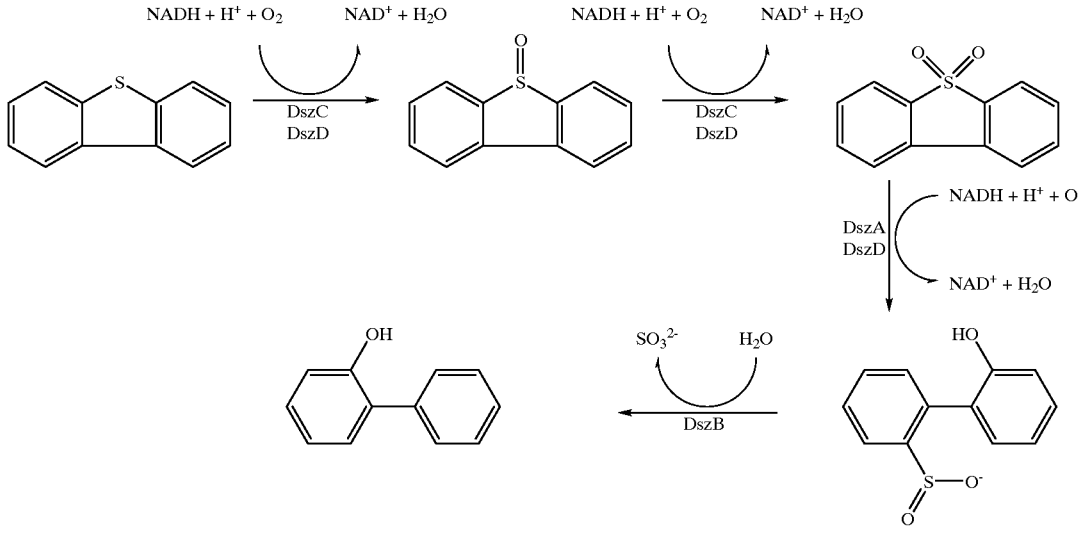

In one embodiment, the biocatalyst of use in the present method is an organism, such as Rhodococcus strain sp. IGTS8, a mutant thereof or another organism, such as a recombinant organism, which exhibits DszC activity, but in which DszA activity is substantially absent or inhibited. Such a system would oxidize DBT to DBTO or $DBTO_2$. The oxyorganosulfur compound could then be removed from the fossil fuel, for example, by adsorption onto a polar solid support, such as alumina or silica gel, or by extraction into a polar solvent.

In a preferred embodiment, the biocatalyst is Rhodococcus strain sp. IGTS8, Sphingomonas sp. strain AD109, a mutant thereof or another organism, such as a recombinant organism, which exhibits DszA and DszC activities, but in which DszB activity is substantially absent or inhibited. Such a biocatalyst would oxidize DBT to HPBS, an anionic, water soluble compound. The HPBS can then be removed from the fossil fuel by contacting the fossil fuel with a polar solvent, preferably an aqueous phase, thereby extracting the HPBS into the polar solvent.

A biocatalyst as discussed above, which exhibits DszC activity and, optionally, DszA activity, can be, for example, a microorganism, such as a bacterium, which contains the gene encoding DszC, and, optionally, the gene encoding DszA. In a preferred embodiment, the biocatalyst is a Rhodococcus strain sp. IGTS8 mutant which contains the genes encoding both DszC and DszA, but from which the gene encoding DszB has been physically or functionally deleted. A physically deleted gene is a gene which has been removed from an organism, such that the gene is no longer expressed. A functionally deleted gene has been mutated, by amino acid substitution, insertion or deletion, to encode a protein which lacks the characteristic activity or function of the native or wild-type protein. The biocatalyst can also be a recombinant organism to which a gene or genes encoding DszC and, optionally, DszA have been added.

A Rhodococcus strain sp. IGTS8 mutant in which the gene encoding DszA or the gene encoding DszB or both have been physically or functionally deleted can be obtained using methods which are well known in the art. Such a mutant can be referred to as a "Rhodococcus strain sp. IGTS8 DszB (and/or DszA) knockout mutant". For example, the target gene can be altered to produce an inactive product. For example the microorganism can be treated with an insertion vector comprising a DNA sequence which inserts into the sequence of the target gene, i.e., the gene encoding DszB or DszA. The target gene can also be altered by deleting a portion of the gene sequence, or by substituting one or more nucleotide bases in the native DNA sequence. Methods for producing mutants of these types, including the preparation of several plasmids which encode mutant genes encoding DszA, DszB, and DszC, are disclosed by Piddington et al., *Appl. Env. Microbiol.* 61: 468–475 (1995), in U.S. Pat. No. 5,356,801, issued to Rambosek et al., and U.S. patent application Ser. No. 08/851,088 (Attorney Docket No. EBC96-06A), the contents of each of which are incorporated herein in their entirety.

The biocatalyst of use in the present method can also be a recombinant non-human host organism which contains a heterologous DNA molecule encoding one or more enzymes which are capable of converting the organosulfur compound to an organosulfur metabolite. Preferably, the enzymes encoded by the heterologous DNA molecule catalyze the oxidation of the organosulfur compound to an oxyorganosulfur compound. In a preferred embodiment, the heterologous DNA molecule encodes DszC and, optionally, either DszA or DszB. In a preferred embodiment, the recombinant microorganism contains a recombinant DNA molecule encoding both DszC and DszA. For example, the DNA encoding DszC and DszA can be transformed into a microorganism, such as a bacterium. The DNA molecule encoding DszC and DszA can be purified and isolated DNA obtained from, e.g., a natural source, such as Rhodococcus sp. IGTS8, as is described in U.S. Pat. No. 5,356,801, or Sphingomonas strain AD109. The DNA can also be synthetic DNA formed by methods known in the art.

A recombinant non-human host organism having DszC activity and, optionally, either DszA or DszB activity, can be prepared by adding heterologous DNA encoding the desired enzyme(s) to the organism using methods known in the art, for example, the methods described in Sambrook et al., *Molecular Cloning: A Laboratory Manual,* 2nd Edition (Cold Spring harbor Laboratory, Cold Spring Harbor, N.Y. (1992)) (hereinafter "Sambrook et al."), and in Ausubel et al., *Current Protocols in Molecular Biology,* Wiley-Interscience, New York (1997)(hereinafter "Ausubel et al."), each of which is incorporated herein by reference. For example, the recombinant plasmid can be introduced via a suitable vector or by electroporation. By the term "non-human host organism" is intended any non-human organism capable of the uptake and expression of foreign, exogenous or recombinant DNA. Preferably, the host organism is a bacterium, more preferably a pseudomonad.

Although living microorganisms (e.g., a culture) can be used as the biocatalyst herein, this is not required. The biocatalyst can also be one or a series of enzymes, or an enzyme preparation, such as a cellular extract. Enzymes are protein biocatalysts made by living cells. Enzymes promote, direct or facilitate the occurrence of a specific chemical reaction or series of reactions (referred to as a pathway) without themselves becoming consumed as a result thereof. Enzymes can include one or more unmodified or post-translationally or synthetically modified polypeptide chains or fragments or portions thereof, additional coenzymes, cofactors, or coreactants which collectively catalyze the desired reaction or series of reactions. Examples of enzymes which can be added to a biodesulfurization system to enhance the biodesulfurization rate are provided in copending U.S. patent application Ser. No. 08/351,754, now abandoned, and Ser. No. 08/583,118, now U.S. Pat. No. 5,846,813, the contents of each of which are incorporated herein by reference.

Biocatalytic enzyme preparations that are useful in the present invention include microbial lysates, extracts, fractions, subfractions, or purified products obtained by conventional means and capable of carrying out the desired biocatalytic function. Generally, such enzyme preparations are substantially free of intact microbial cells, i.e., the enzyme preparations are cell-free fractions. Kilbane and Monticello disclose enzyme preparations that are suitable for use herein in U.S. Pat. No. 5,132,219 (issued Jul. 21, 1992), and U.S. Pat. No. 5,358,870 (filed Jun. 11, 1992), for example. Rambosek et al. disclose recombinant microorganisms and enzyme preparations, including enzymes, engineered from Rhodococcus sp. ATCC No. 53968 and suitable for use herein, in U.S. Pat. No. 5,356,801, incorporated herein by reference. In a particularly preferred embodiment, the biocatalyst is overexpressed in the recombinant host cell (such as a cell which contains more than one copy of the gene or genes).

For example, as discussed above, the desulfurization of dibenzothiophene by Rhodococcus sp. IGTS8 has been shown to involve the three enzymes DszA, DszB and DszC, of which DszA and DszC are monooxygenases. As such, in a particularly preferred embodiment, the biocatalyst includes the enzymes DszC and DszA. The enzymes can be isolated from Rhodococcus strain sp. IGTS8, a knockout mutant thereof, another microorganism capable of desulfurizing fossil fuels, or a recombinant organism containing heterologous DNA which encodes one or more enzymes capable of converting the organosulfur compound.

Enzyme biocatalyst preparations suitable for use herein can optionally be affixed to a solid support, e.g., a membrane, filter, polymeric resin, glass particles or beads, or ceramic particles or beads. The use of immobilized enzyme preparations facilitates the separation of the biocatalyst from the treated fossil fuel.

The specific activity of a given biocatalyst is a measure of its biocatalytic activity per unit mass. Thus, the specific activity of a particular biocatalyst depends on the nature or identity of the microorganism used or used as a source of biocatalytic enzymes, as well as the procedures used for preparing and/or storing the biocatalyst preparation. The concentration of a particular biocatalyst can be adjusted as desired for use in particular circumstances. For example, where a culture of living microorganisms (e.g., ATCC No. 53968) is used as the biocatalyst preparation, a suitable culture medium lacking a sulfur source other than sulfur-bearing heterocycles can be inoculated with suitable microorganisms and grown until a desired culture density is reached. The resulting culture can be diluted with additional medium or another suitable buffer, or microbial cells present in the culture can be retrieved e.g., by centrifugation, and resuspended at a greater concentration than that of the original culture. The concentrations of microorganism and enzyme biocatalyst can be adjusted similarly. In this manner, appropriate volumes of biocatalyst preparations having predetermined activities can be obtained.

The reaction or series of reactions relevant to the present invention culminates in the conversion of a refractory organosulfur compound, such as a sulfur-bearing heterocycle to an organosulfur metabolite which is separable from the fossil fuel. The hydrocarbon framework of the former refractory organosulfur compound remains substantially intact. Microorganisms or enzymes employed as biocatalysts in the present invention advantageously do not consume the hydrocarbon framework of the former refractory organosulfur compound as a carbon source for growth. As a result, the fuel value of substrate fossil fuels treated by the present method does not deteriorate.

In a preferred embodiment, the organosulfur compound is dibenzothiophene (DBT), a substituted dibenzothiophene, or a combination thereof, and the biocatalyst is a microorganism or enzyme preparation which includes DszA and DszC, but does not contain a significant amount of active DszB. In this case, the organosulfur metabolite is 2-(2'-hydroxyphenyl)benzenesulfinate (HBPS) or a derivative thereof. HBPS is a water soluble compound and can be removed from the fossil fuel by contacting the fossil fuel with an aqueous phase, such as water or an aqueous buffer solution, thereby extracting the HPBS into the aqueous phase. The aqueous phase is then separated from the fossil fuel.

The aqueous phase containing the HBPS can be discarded or the HBPS can be recovered by dehydration and, optionally, purified using standard techniques. The HPBS can also be further processed via, for example, a biocatalyzed process, or a standard refinery unit process.

In one embodiment, the HBPS is treated with a biocatalyst which comprises desulfinase activity, thereby converting the HBPS to HBP. Suitable biocatalysts include those comprising the DszB enzyme. The biocatalyst can be, for example, Rhodococcus sp. IGTS8, or a recombinant organism containing a heterologous dszB gene. Such a recombinant organism can be prepared by methods previously discussed. The biocatalyst can also be an enzyme preparation comprising DszB. The resulting HBP can be recovered and/or added to a petroleum stream.

In another embodiment, the HBPS is treated in a refinery unit process, such as a hydrodesulfurization process, a fluid catalytic cracking unit (FCCU) process, a coker, a visibreaker or similar unit process. As processes such as these cannot operate with large amounts of water or high sodium levels, HPBS is, preferably, converted to a neutral, organic-soluble species prior to further processing.

For example, HPBS can be converted to dibenzothiophene sultine (DBTSi) prior to further processing. HPBS can be converted to dibenzothiophene sultine by acidifying the aqueous phase to a pH below about 2, thereby inducing the reaction shown below:

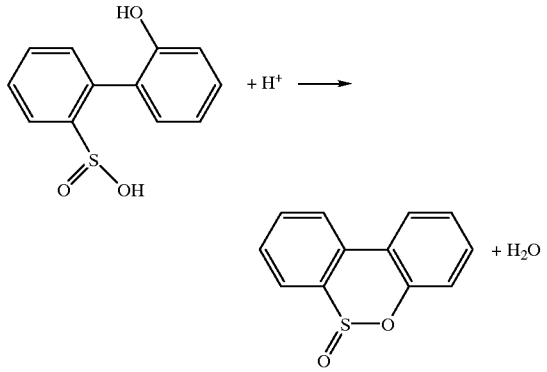

DBTSi is a neutral aromatic compound with greater solubility in organic media than in aqueous media.

The DBTSi can be recovered from the aqueous phase by conventional methods. For example, depending upon the initial concentration of HPBS in the aqueous phase, the product DBTSi can precipitate from the aqueous phase and can be recovered as a solid by filtration. The DBTSi can also be recovered by removing the water from the aqueous phase, for example, under reduced pressure and/or elevated temperature. The recovered DBTSi can then be added to a petroleum stream and treated via one of the refinery processes discussed above. The aqueous phase can also be contacted with a hydrocarbon phase, such as a petroleum stream, thereby extracting the DBTSi from the aqueous phase into the hydrocarbon phase. The resulting aqueous phase can then be treated via one of the refinery processes discussed above.

The invention will now be further and specifically described in the following examples.

EXAMPLES

Example 1

Reaction kinetics of the conversion of 2-(2-hydroxyphenyl) benzenesulfinate to dibenzothiophenesultine The reaction kinetics of the conversion of 2-(2-hydroxyphenyl)benzenesulfinate to dibenzothiophenesultine were determined at 25° C. and 50° C. using dilute HPBS solutions in amber-glass batch reactors. HPBS concentrations ranged from 50 mm to 170 mm and the reaction was examined at pH 1.25, 0.74 and 0.48. The disappearance of HBPS and the appearance of dibenzothiophenesultine as a function of time were monitored via high performance liquid chromatography.

FIG. 1 presents the data at pH 1.25 plotted as ln[HPBS]/$[HPBS]_o$ versus time, where $[HPBS]_o$ is the initial HPBS concentration. The resulting plot is substantially linear, indicating a first order dependence of the reaction rate on the HPBS concentration.

The dependence of the rate on pH was also determined, and the overall rate expression for the disappearance of HPBS is given by the expression:

$$\text{rate}=-k[\text{HPBS}][H^+]^{1/2};$$

The rate constant k was determined from this equation and the temperature dependence of k was approximated from the data obtained at 25° C. and 50° C. K can be approximated as $$1.73\times10^6\exp(-7.75\times10^3/T),$$

where T is the absolute temperature.

Example 2

Preparation of 2-(2-hydroxyphenyl)benzenesulfinic acid

The pH of a concentrated (>50 mM) HPBS solution was adjusted to 1.2 at ambient temperature with concentrated sulfuric acid. An amorphous white precipitate formed rapidly and the supernatant HPBS concentration, as determined by HPLC, dropped to the range of 5–8 $\mu$M. The precipitate was only sparingly soluble in organic solvents, such as toluene, but dissolved rapidly in water at neutral pH.

The precipitation occurred at a pH which corresponds to the typical pKa range for sulfinic acids, suggesting that the precipitate is the protonated form of HPBS, 2-(2-hydroxyphenyl)benzenesulfinic acid. An aqueous solution of the precipitate was analyzed by gel permeation chromatography and by the Smiles test for the sulfinate group. This solution was indistinguishable from an aqueous solution of HPBS, further supporting the identification of the precipitate as 2-(2-hydroxyphenyl)benzenesulfinic acid.

Example 3

Characterization of 2-(2-hydroxyphenyl)benzenesulfinic acid

Acid requirements for the precipitation of 2-(2-hydroxyphenyl)benzenesulfinic acid were determined via titration with hydrochloric acid or sulfuric acid for solutions prepared from synthetic HPBS or HPBS derived from the biocatalytic oxidation of DBT. The titrations were conducted using standard methods.

Figure 2:
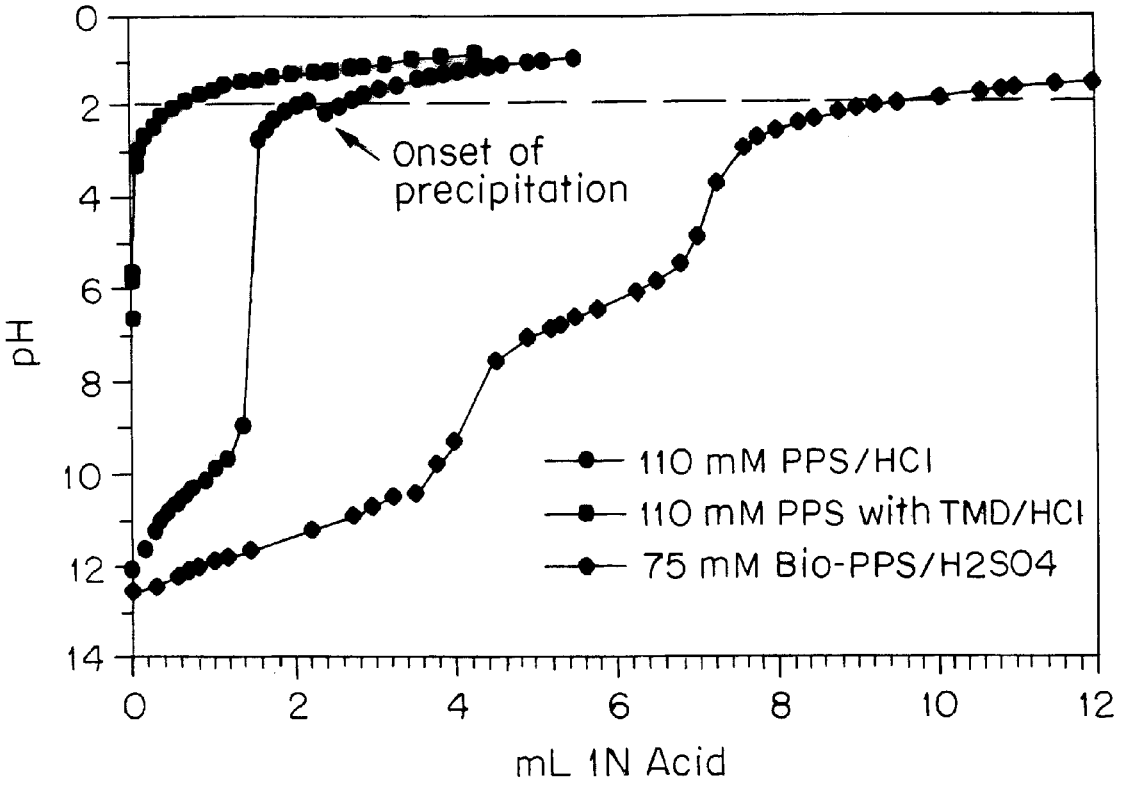
FIG. 2 presents titration curves for the titration of HPBS with hydrochloric acid and sulfuric acid.

FIG. 2 presents titration curves from 3 experiments. In experiment 1, a 110 mM solution of HPBS at pH 13 was treated with aqueous HCl. The HPBS phenolic group was titrated first, with a pKa of about 10.5. Precipitation of solid 2-(2-hydroxyphenyl)benzenesulfinic acid began at about pH 2, as the sulfinate group was protonated. This is consistent with the acid/base behavior of benzenesulfinic acid (pKa= 1.2).

In experiment 2, a 110 mM HPBS solution equilibrated with a middle distillate (or diesel fuel) at 30° C. and pH 6.6 was titrated with HCl. The middle distillate was added to determine if the presence of middle distillate components have any effect on the protonation of HPBS. The acid requirement for pH adjustment from pH 6.6 to pH 1 and precipitation was identical to that observed in experiment 1, indicating that middle distillate did not have a significant effect on this system.

In experiment 3, a 75 mM solution of HPBS prepared via the biocatalytic oxidation of DBT was titrated with sulfuric acid. This sample also included phosphate buffer and, therefore, required substantially more acid to reach pH 1.

Example 4

Conversion of HPBS to DBTSi

A series of seven reaction rate experiments were conducted at HPBS concentrations in the range 0.5 mM to 5 mM over the pH range of 0.5 to 1.2. A white crystalline precipitate formed slowly in each case and was identified as DBTSi. A similar experiment conducted with a 33 mM HPBS solution resulted in the precipitation of amorphous 2-(2-hydroxyphenyl)benzenesulfinic acid upon reduction of solution pH, followed by the slow precipitation of crystalline DBTSi.

Figure 3:
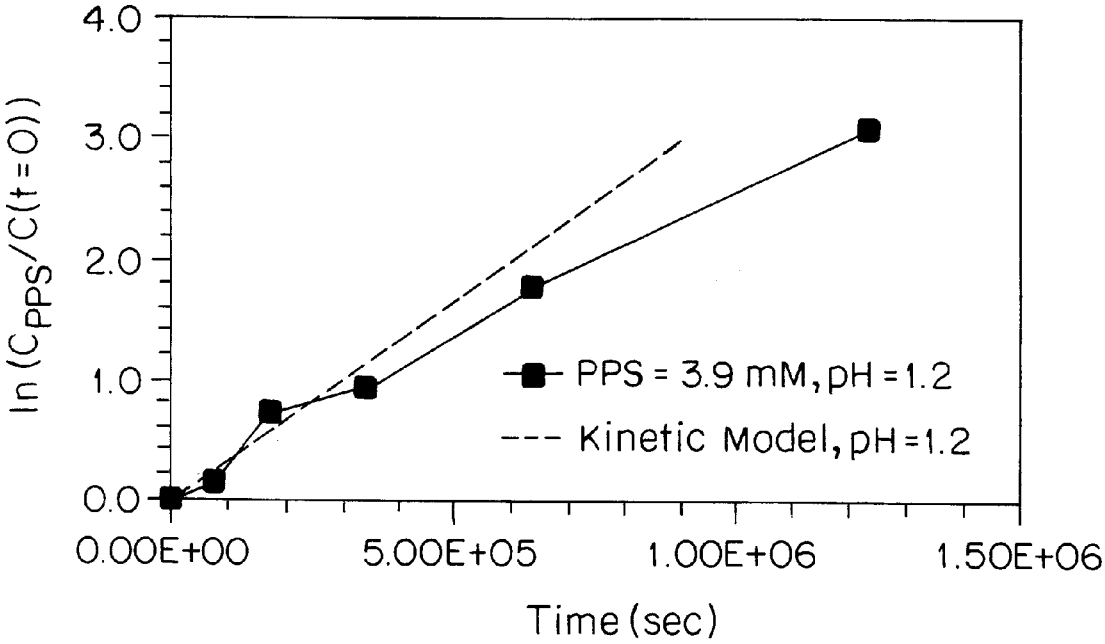
FIG. 3 presents a plot of $-\ln([HPBS]_t/[HPBS]_o)$ as a function of reaction time, t, for a solution originally 3.9 mM in HPBS and pH 1.2.

The observed kinetics of HPBS conversion to DBTSi at moderate concentrations agreed with those predicted on the basis of the rate expression presented in Example 1. Results from an experiment at 3.9 mM HPBS and pH 1.2 are presented in FIG. 3. This figure presents $-\ln([HPBS]_t/[HPBS]_o)$ as a function of reaction time, t, yielding a linear plot. The dashed line shows the relationship predicted from the kinetic model described in Example 1.

a second series of experiments was conducted at 60° C. for HPBS concentrations of less than 200 $\mu$M over the pH range of 1.2 to 0.5. Initial rates were approximately 30% higher than predicted, suggesting the need for modification of the temperature dependence of the rate constant.

Example 5

Solubility of 2-(2-hydroxyphenyl)benzenesulfinic acid and DBTSi in liquid hydrocarbons The solubilities of 2-(2-hydroxyphenyl)benzenesulfinic acid and DBTSi in liquid hydrocarbons such as gas-oil or vacuum-gas-oil in an important parameter in process design as such refinery streams represent ultimate disposal sites for HPBS. At ambient temperature, the solubility of 2-(2-hydroxyphenyl)benzenesulfinic acid in the hydrocarbons hexadecane, toluene and TMD was below the limits of detection by x-ray fluorescence. Similarly, no detectable solubility was observed in gas-oil or middle distillate at 50° C.

DBTSi is substantially more soluble in liquid hydrocarbons. For example, at 30° C. the solubility of DBTSi in the liquid hydrocarbons tested was as follows: hexadecane: 0.33% by weight; middle distillate: ca. 1%; gas-oil: ca. 1.4%; and vacuum gas oil (60° C.): 4.3%. In each case, the solubility of DBTSi in the hydrocarbon increased with increasing temperature.

The melting point of 2-(2-hydroxyphenyl)-benzenesulfinic acid was determined to be 99.5–101.5° C. This compound, thus, would be expected to melt in a vapor-gas-oil stream and could be carried as a liquid/liquid dispersion. DBTSi, however, would be expected to dissolve in the hydrocarbon at elevated temperature and could be carried as a solution.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

We claim:

1. A method for desulfurizing a fossil fuel containing an organosulfur compound, comprising the steps of:

(a) contacting the fossil fuel with a biocatalyst comprising a microorganism, wherein said biocatalyst catalyzes the conversion of the organosulfur compound to an organosulfinate or organosulfonate compound, under conditions suitable for the conversion of the organosulfur compound to the organosulfinate or organosulfonate compound; and (b) separating the organosulfinate or organosulfonate compound from the fossil fuels thereby producing a desulfurized fossil fuel.

2. The method of claim 1 wherein the organosulfinate or organosulfonate compound is separated from the fossil fuel by contacting the fossil fuel with a polar solvent, thereby extracting the organosulfinate or organosulfonate compound into the polar solvent.

3. The method of claim 2 wherein the polar solvent is water or an aqueous solution.

4. The method of claim 1 wherein the organosulfinate or organosulfonate compound is removed from the fossil fuel by contacting the fossil fuel with a polar solid support, thereby adsorbing the organosulfinate or organosulfonate compound onto the polar adsorbent material.

5. The method of claim 1 wherein the organosulfur compound is dibenzothiophene, a substituted derivative thereof or a combination thereof.

6. The method of claim 5 wherein the oxyorganosulfinate compound is 2-(2-hydroxyphenyl)benzenesulfinate, a substituted derivative thereof or a combination thereof.

7. The method of claim 6 wherein the organosulfinate compound is separated from the fossil fuel by contacting the fossil fuel with an aqueous phase, thereby extracting the organosulfinate compound into the aqueous phase.

8. The method of claim 7 further comprising the step of acidifying the aqueous phase to a pH sufficient for the spontaneous conversion of the organosulfinate compound to a sultine compound.

9. The method of claim 1 wherein the fossil fuel is a liquid hydrocarbon.

10. The method of claim 1 wherein the biocatalyst is capable of oxidizing the organosulfur compound.

11. The method of claim 10 wherein the biocatalyst is a cell-free fraction.

12. The method of claim 11 wherein the biocatalyst comprises one or more enzymes derived from an organism capable of cleaving carbon-sulfur bonds.

13. The method of claim 12 wherein the microorganism capable of cleaving carbon-sulfur bonds is Rhodococcus strain sp. IGTS8 or Sphingomonas sp. strain AD109.

14. The method of claim 13 wherein the biocatalyst comprises DszC.

15. The method of claim 13 wherein the biocatalyst comprises DszC and DszA.

16. The method of claim 1 wherein the biocatalyst is a microorganism.

17. The method of claim 16 wherein the biocatalyst is a Rhodococcus strain sp. IGTS8 mutant which does not express active DszB.

18. The method of claim 16 wherein the microorganism contains a DNA molecule which encodes one or more enzymes capable of oxidizing the organosulfur compound.

19. The method of claim 18 wherein the DNA molecule is a recombinant DNA molecule.

20. The method of claim 19 wherein the recombinant DNA molecule is derived from Rhodococcus strain sp. IGTS8.

21. The method of claim 20 wherein the recombinant DNA molecule encodes DszC and DszA.

* * * * *